US005398808A

United States Patent [19]

Chen et al.

[11] Patent Number: 5,398,808

[45] Date of Patent: Mar. 21, 1995

[54] BUFFER DEVICE FOR PACKINGS

[75] Inventors: Hsi-Chin Chen; Ching-Song Wang, both of Hsinchu, Taiwan, Prov. of China

[73] Assignee: Umax Data System Inc., Hsinchu, Taiwan, Prov. of China

[21] Appl. No.: 277,819

[22] Filed: Jul. 20, 1994

[51] Int. Cl.[6] ..... B65D 81/06; B65D 81/16

[52] U.S. Cl. ..... 206/320; 206/587; 206/591

[58] Field of Search ..... 206/328, 320, 587, 588, 206/591, 592, 594, 586

[56] References Cited

U.S. PATENT DOCUMENTS

| | | | |
|---|---|---|---|
| 4,792,043 | 12/1988 | Holladay | 206/587 X |
| 4,899,884 | 2/1990 | Madsen | 206/587 X |
| 5,040,721 | 8/1991 | Essack | 206/588 X |
| 5,341,934 | 8/1994 | Hsu | 206/591 |

*Primary Examiner*—Jacob K. Ackun, Jr.
*Attorney, Agent, or Firm*—Lowe, Price, LeBlanc & Becker

[57] ABSTRACT

A buffer device for packings, including at least one base unit, each base unit constructed of an elongated, channel-like base frame and two supporting frames joined by the base frame, the base frame being formed by folding up a punched cardboard and, having a rectangular horizontal bottom wall and two vertical side walls raised from two opposite long sides of the horizontal bottom walls, each supporting frame being formed by folding up a respective punched cardboard and having a vertical side wall and a side matched rectangular box, the vertical side wall of either supporting frame being top notched and engaged into a mounting slot at either end of the base frame to block up either open end of the base frame permitting the horizontal bottom wall of the base frame to be supported on the rectangular box of either supporting frame.

7 Claims, 5 Drawing Sheets

BUFFER DEVICE FOR PACKINGS

BACKGROUND OF THE INVENTION

The present invention relates to a buffer device for use in packing a scanner, personal computer mainframe, notebook computer, or any of a variety of electronic or computer peripheral equipment within a carton to support the product against shocks.

When packing a scanner, personal computer mainframe, notebook computer, or any of a variety of electronic or computer peripheral equipment, the corners and edges of the product must be protected before the product is put in the carton. Regular buffer devices for this purpose are commonly molded from foamed plastics. However, the production of foamed plastics will cause environmental pollutions. Recently, cardboards have been intensively used or bounded with EPE, EPS, EPP, PU for packing products in cartons. This method can only reduce the amount of foamed plastics. Because of the use of foamed plastics, the buffer devices cannot be recycled. Furthermore, the use of foamed plastics for packing electronic and computer products does not meet the requirements for "Green Computer" in the USA, the requirements for "Green Dot" in West Germany, or the regulations of the disposal of electronic waste products in European countries.

SUMMARY OF THE INVENTION

The present invention has been accomplished under the aforesaid circumstances. It is therefore one object of the present invention to provide a buffer device for packings which can be recycled. It is another object of the present invention to provide a buffer device which does not produce environmental; pollutions during its manufacturing, use, recycling, or disposal. It is still another object of the present invention to provide a buffer device which effectively protects the product being packed against shocks. It is still another object of the present invention to provide a buffer device which is assembled through tongue-and-groove joints without the use of any bonding agent or external fastening elements. It is still another object of the present invention to provide a buffer device which is detachable and can be conveniently set up.

DETAILED DESCRIPTION OF THE PREFERRED EMBODIMENT

Figure 1:
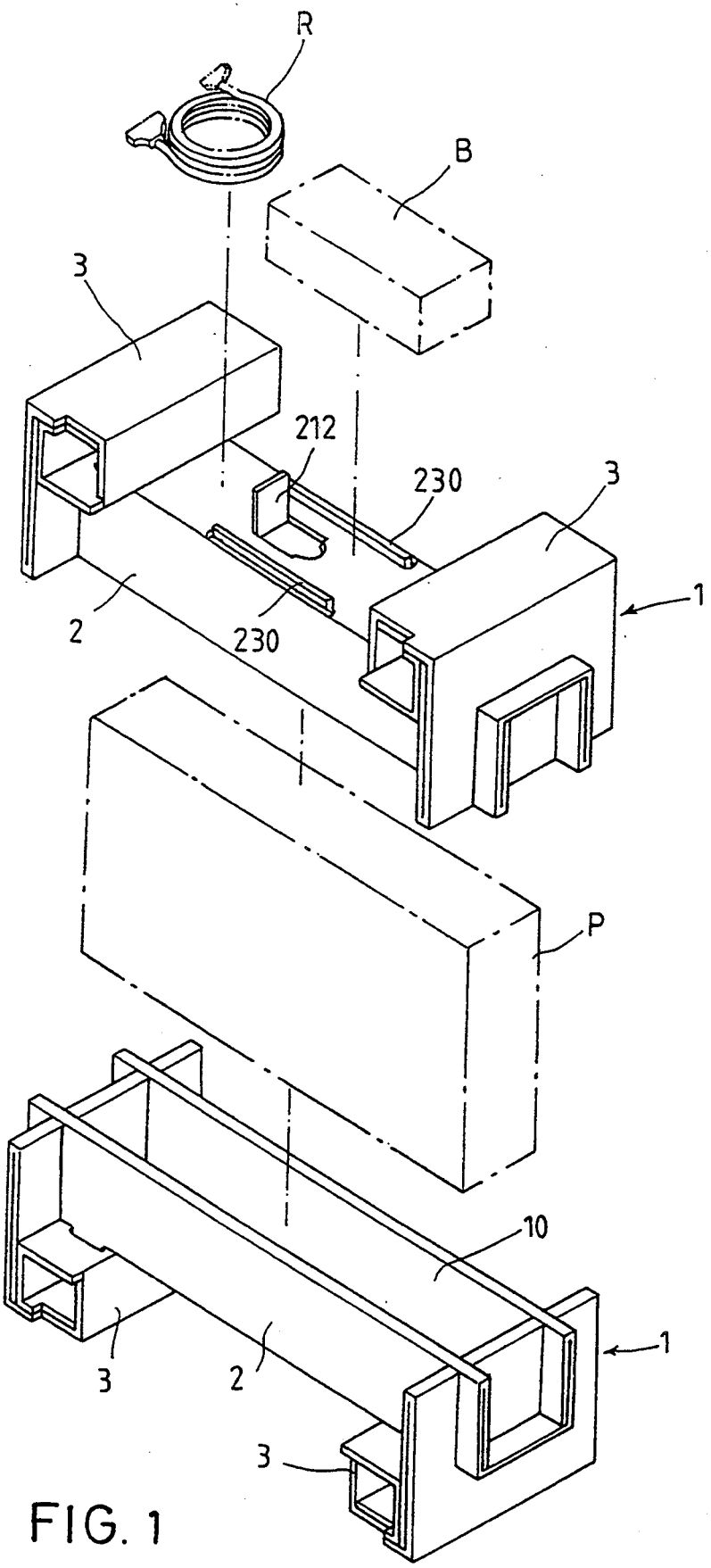
FIG. 1 is an exploded view of a buffer device according to the present invention.
Figure 7:
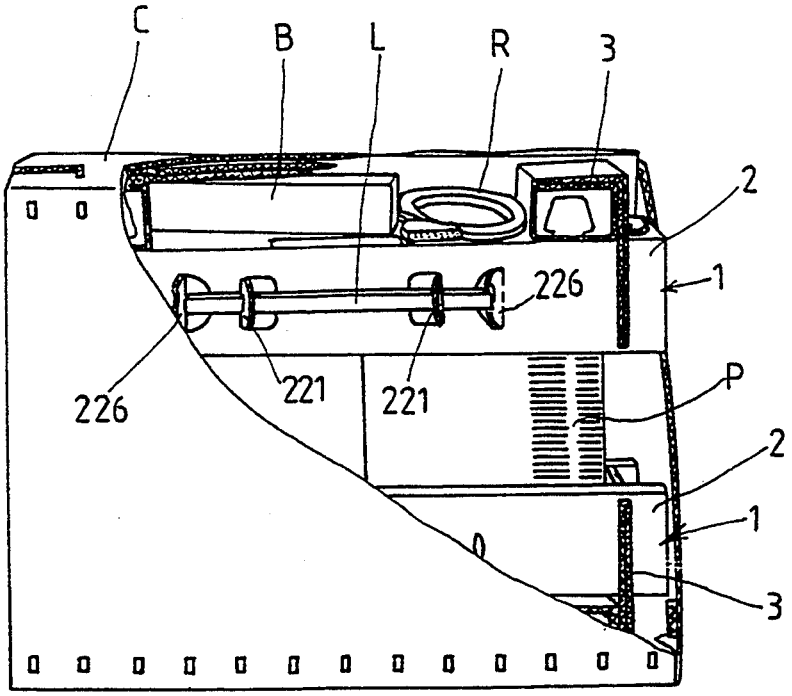
FIG. 7 shows the buffer device of the present invention installed.

Referring to FIGS. 1 and 7, a buffer device in accordance with the present invention is generally comprised of two base units 1 mounted on the product P at two opposite ends and received inside the carton C to protect the product P against shocks. The base unit 1 defines a receiving chamber 10, which receives either end of the product P.

Figure 2:
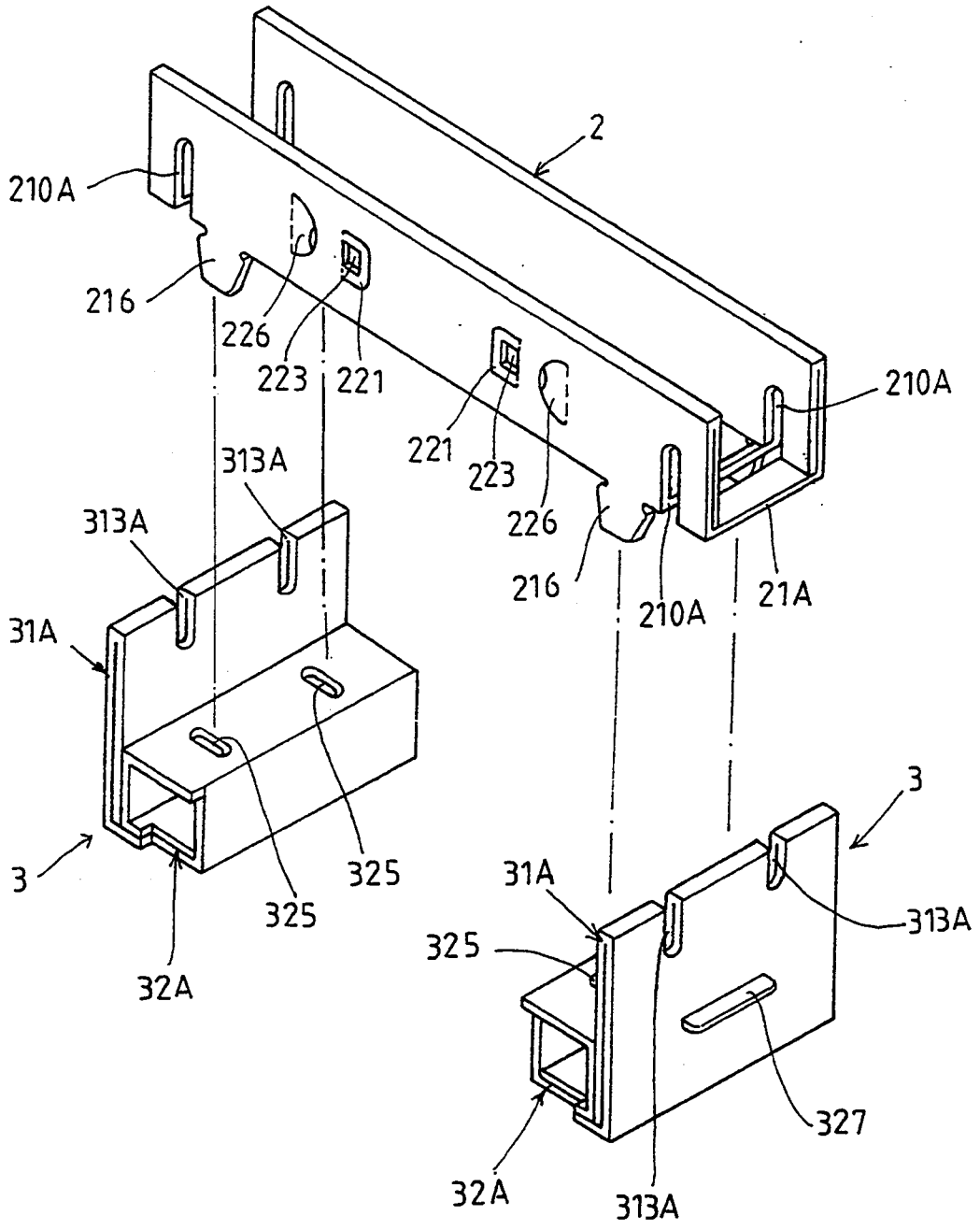
FIG. 2 is an exploded view of a base unit for the buffer device shown in FIG. 1.

Referring to FIGS. 1 and 2, the base unit 1 comprises an elongated, channel-like base frame 2, and two supporting frames 3 joined by the base frame 2.

Figure 3:
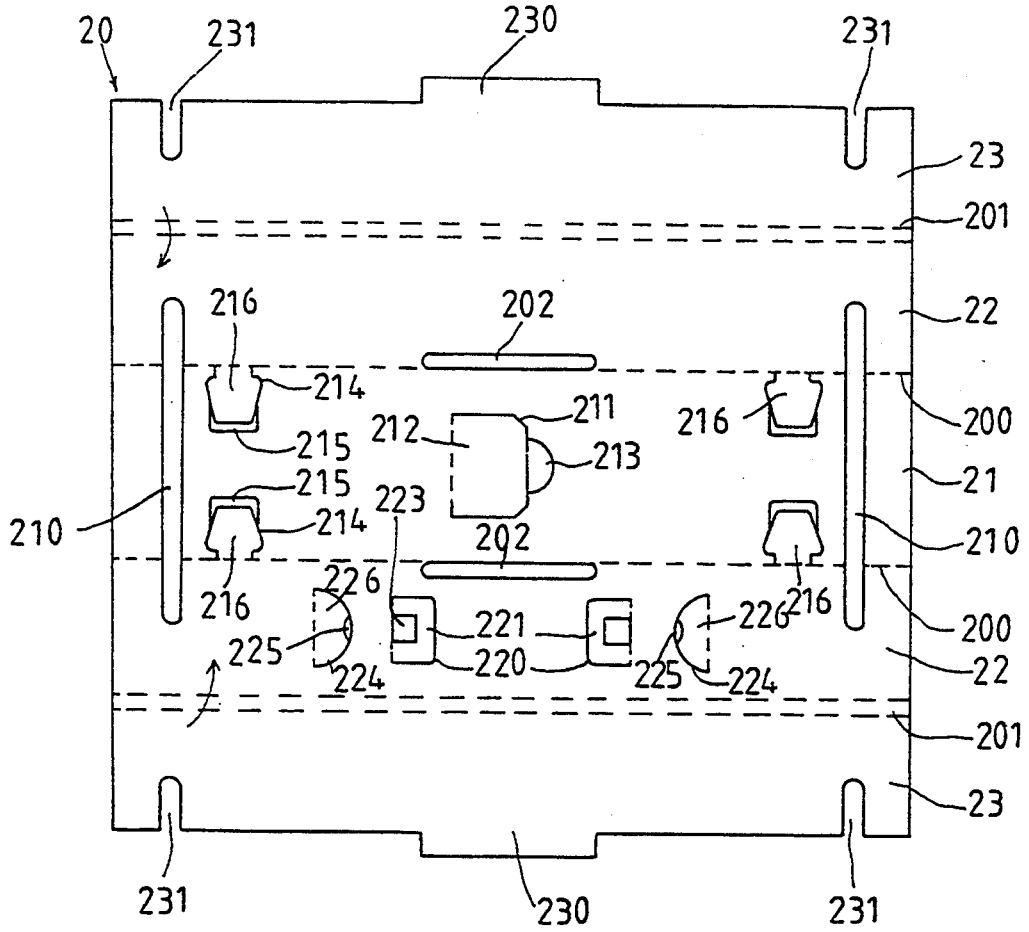
FIG. 3 is a plain view showing the base frame of the base unit shown in FIG. 2 spread out.
Figure 4:
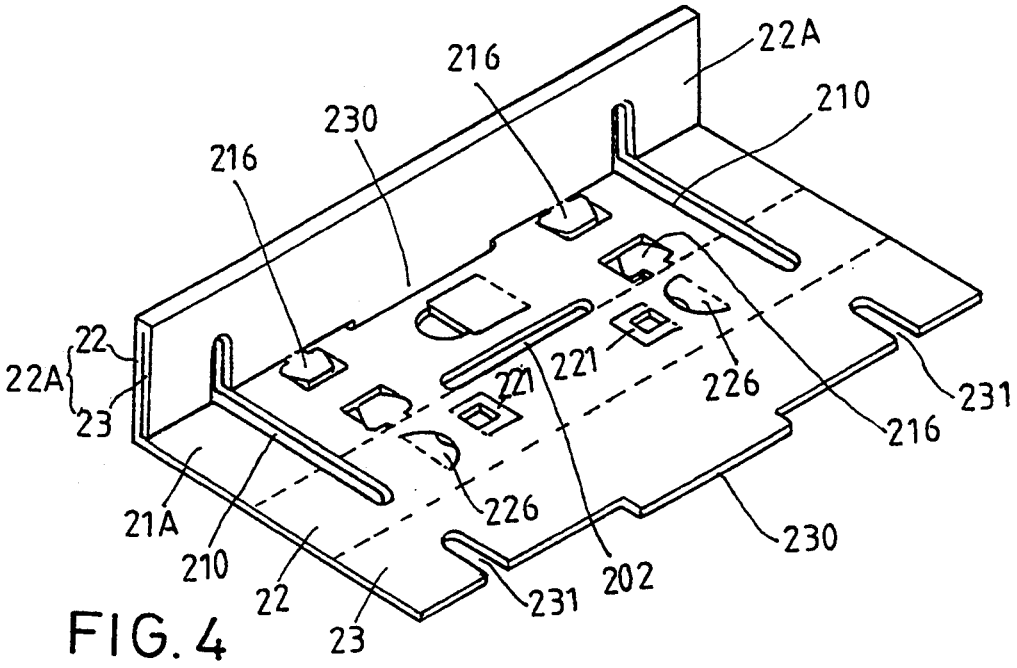
FIG. 4 shows the base frame of FIG. 3 partially folded up.

Referring to FIGS. 3 and 4 and FIG. 2 again, the base frame 2 is made by punching a cardboard 20 according to a predetermined design and then folding up the punched cardboard 20 into shape. The punched cardboard 20, as shown in the spread-out view of FIG. 3, comprises a bottom wall panel 21 in the middle, two side wall reinforcing panels 23 at two opposite sides, and two side wall panels 22 bilaterally linked between the bottom wall panel 21 and the side wall reinforcing panels 23. The bottom wall panel 21 is connected to either side wall panel 22 by a respective folding line 200. The side wall panels 22 and the side wall reinforcing panels 23 are respectively connected by a respective pair of parallel folding lines 201 such that the side wall panels 22 and the side wall reinforcing panels 23 can be folded up and side matched. The side wall panels 22 comprise each a rectangular locating flap 230 projecting outwards in the middle, and two side notches 231 transversely disposed near two opposite ends thereof. There are two longitudinal slots 202 respectively made on the folding lines 200 in the middle in length slightly shorter than the that of the rectangular flaps 230, and two transverse slots 210 transversely made through the bottom wall panel 21 and respectively aligned between the side notches 231 on the side wall reinforcing panels 23 with its two opposite ends respectively perpendicularly extended to the longitudinal center line of either side wall panel 22. The bottom wall panel 21 comprises a longitudinal baffle flap 212 in the middle, which is formed by making a cut line 211 on the bottom wall panel 21, a finger hole 213 in the front of the baffle flap 212, two pairs of retainer flaps 216, which are formed by making cut lines 214 and cut holes 215 on the bottom wall panel 21, respectively inwards extended from the folding lines 200 and disposed near two opposite ends thereof within the transverse slots 210. One side wall panel 22 comprises two rectangular supporting flaps 221 longitudinally spaced in the middle formed by making two spaced cut lines 220 on the side wall panel 22 and having each a rectangular through hole 223, and two stop flaps 226 formed by by making two spaced semi-circular cut lines 224 and two finger holes 225 at suitable locations. The aforesaid finger holes 213 and 215 and cut holes 215 are for inserting the fingers to lift the baffle flap 212, the retainer flaps 216 and the stop flaps 226 respectively.

Referring to FIGS. 2, 3, and 4 again, the side wall reinforcing panels 23 are folded up and side matched with the side wall panels 22 respectively permitting the rectangular locating flaps 230 to insert into the longitudinal slots 202 respectively, and therefore the side wall panels 22 and the side wall reinforcing panels are respectively side matched and formed into two opposite vertical side walls 22A bilaterally disposed along the length of the horizontal bottom wall 21A, which is formed of the bottom wall panel 21. When the channel-like base frame 2 is set up, the side notches 231 are respectively communicated with the transverse slots 210 and incorporated with transverse slots 210 into two transverse mounting slots 210A near two opposite ends of the channel-like base frame 2, the retainer flaps 216 are bilaterally perpendicularly extended from the horizontal bottom wall 21A. Before use, the baffle flap 212 and the stop flaps 226 are respectively disposed in flush with the bottom wall panel 21 or the corresponding side wall panel 22.

Figure 5:
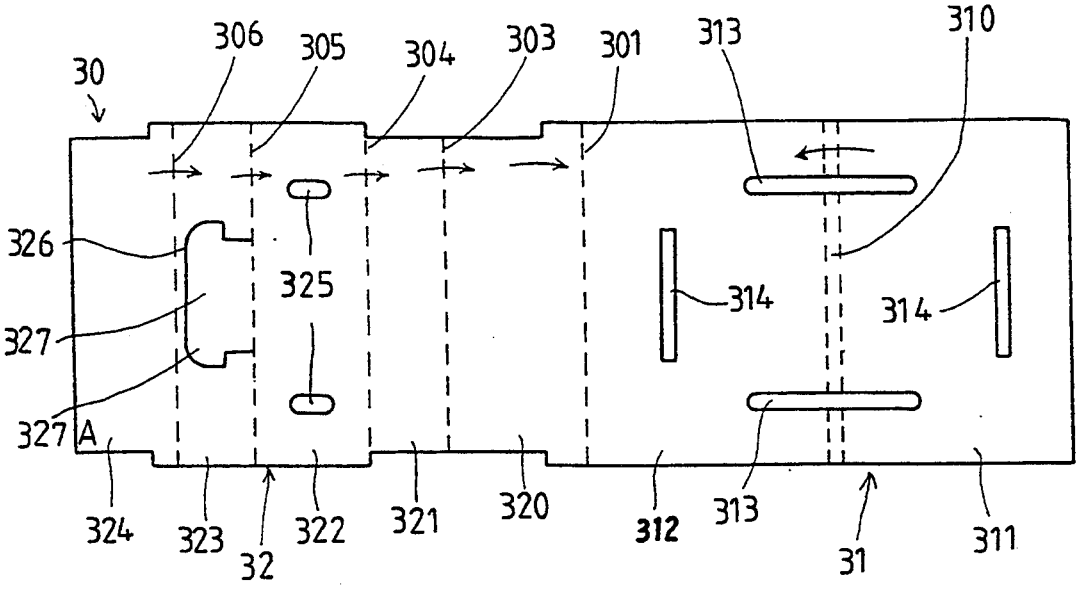
FIG. 5 is a plain view showing the supporting frame of the base unit shown in FIG. 2 spread out.
Figure 6:
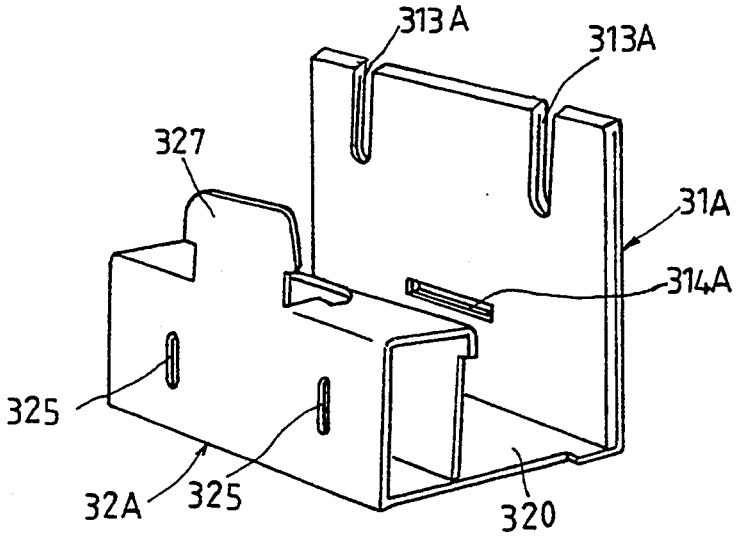
FIG. 6 shows the supporting frame of FIG. 5 partially folded up.

Referring to FIGS. 5 and 6 and FIG. 2 again, the supporting frame 3 is made by punching a rectangular cardboard 30 according to a predetermined design and then folding up the punched cardboard 30 into shape. The rectangular cardboard 30, as shown in the spread-out view of FIG. 5, is divided into a first panel 31 and a second panel 32 by a transverse folding line 301. The first panel 31 comprises two parallel folding lines 310 transversely disposed in the middle, a side wall panel 311 and a side wall reinforcing panel 312 separated by the parallel folding lines 310, two longitudinal slots 313 across the parallel folding lines 310, and two transverse slots 314 bilaterally disposed in parallel with and spaced by the parallel folding lines 310. The distance between the longitudinal slots 313 is equal to the width of the horizontal bottom wall 21A of the channel-like base frame 2. The half length of the longitudinal slots 313 is approximately equal to the distance between the elevation of the top ends of the transverse mounting slots 210A and the elevation of the topmost edge of the side walls 22A. When the side first panel 31 is folded up along the parallel folding lines 310, the side wall panel 311 and the side wall reinforcing panel 312 are side matched (see the leftward direction of the left-sided arrow in FIG. 5) and formed into a vertical side wall 31A for the supporting frame 3, the transverse slots 314 are matched into a horizontal retaining slot 314A on the vertical side wall 31A, and the longitudinal slots 313 are formed into a respective top notch 313A on the vertical side wall 31A. The second panel 32 comprises four transverse folding lines 303, 304, 305 and 306, and five side wall panels 320, 321, 322, 323 and 324 separated from one another by the transverse folding lines 303, 304, 305 and 306. The side wall panel 322 comprises two retaining slots 325. The distance between the retaining slots 325 is approximately equal to the distance between the two retainer flaps 216 at either end of the bottom wall 21A of the channel-like base frame 2 so that either pair of the retainer flaps 216 of the channel-like base frame 2 can be inserted into the retaining slots 325 on the supporting frame 3. The side wall panel 323 comprises a retainer flap 327 formed by making a cut line 326 on the side wall panel 323. The retainer flap 327 has an expanded head 327A. The width of the head 327A of the retainer flap 327 is wider than the transverse slots 314. The five side wall panels 324, 323, 322, 321 and 320 of the second panel 32 are respectively properly folded up along the folding lines 306, 305, 304 and 303 (see the rightward direction of the left-sided arrows in FIG. 5), and therefore the second panel 32 is set into a rectangular box 32A. When the second panel 32 is set into a rectangular box 32A, the head 327A of the retainer flap 327 is engaged into the retaining slot 314A, and therefore the rectangular box 32A and the vertical side wall 31A are incorporated together. When the supporting frame 3 is set up, the retaining slots 325 are horizontally disposed on the rectangular box 32A at the top.

When to assemble a channel-like base frame 2 and two supporting frames 3 into a base unit 1, the two supporting frames 3 are disposed at two opposite sides with the rectangular boxes 32A thereof facing each other, then the channel-like base frame 2 is fastened to the two supporting frames 3 by inserting the four retainer flaps 216 of the base frame 2 into the retaining slots 325 on either supporting frame 3, permitting the transverse mounting slots 210A of the base frame 2 to be respectively engaged with the top notches 313A on either supporting frame 3 (i.e., permitting the part of the vertical side wall 31A which is defined between the two top notches 313A to insert into either transverse mounting slot 210A on the base frame 2). When assembled, the two opposite vertical side walls 22A and horizontal bottom wall 21A of the base frame 2 and the vertical side walls 31A of the supporting frames 3 define a receiving chamber 10.

Referring to FIG. 7, two base units 1 are mounted on the product P at two opposite ends and then received inside the carton C to protect the product P against shocks. Before placing the base units 1 and the product P into the carton C, the supporting flaps 221 and the stop flaps 226 are respectively erected into the operative position perpendicular to the respective vertical side wall 22A, so that the lamp tube L can be inserted through the rectangular through holes 223 on the supporting flaps 221 and stopped between the stop flaps 226. Furthermore, the baffle flap 212 on the base frame 2 of the base unit 1 being disposed at the top may be erected so that the bottom wall 21A of the base frame 2 and the baffle flap 212 of the bottom wall 21A and the rectangular boxes 32A of the two supporting frames 3 define two separate receiving spaces for keeping the operation manual B and the cable R of the product P.

As indicated, the buffer device of the present invention is made by folding up cardboards into base and supporting frames and then fastening the base and supporting frames together through tongue-and groove joints without the use of any adhesive glue or external fastening elements. Therefore, the buffer device can be recycled without causing any environmental pollutions. Because the base frame 2 is supported on the rectangular boxes 32A of the supporting frames 3 and the two opposite ends of the base frame 2 project out of the vertical side walls 31A of the supporting frames 3 at a certain distance and, because the vertical side walls 22A of the base frame 2 are respectively formed of a side wall panel 22 and a side wall reinforcing panel 23 side-matched together, the buffer device provides a satisfactory shock absorbing ability.

While only one embodiment of the present invention has been shown and described, it will be understood that various modifications and changes could be made without departing from the spirit and scope of the invention.

What is claimed is:

1. A buffer device for packings, comprising at least one base unit (1), the at least one base unit (1) respectively comprised of an elongated, channel-like base frame (2) and two supporting frames (3) joined by the base frame (2), the base frame (2) being made by folding up a punched cardboard (20) and, comprising a rectangular horizontal bottom wall (21A), two rectangular vertical side walls (22A) raised from two opposite long sides of the horizontal bottom walls (21A) and disposed in parallel with each other, and two mounting slots (210A) across the horizontal bottom wall (21A) near two opposite ends thereof and having each two opposite ends respectively extended through either vertical side wall (22A), each supporting frame (3) being made by folding up a respective punched cardboard (30) and, comprising a rectangular vertical side wall (31A) and a rectangular box (32A) side matched with the rectangular vertical side wall (31A), the rectangular vertical side wall (31A) of either supporting frame (3) comprising two vertical top notches (313A) spaced at the top, the mounting slots (210A) being engaged with the top notches (313A) permitting the horizontal bottom wall (21A) of the base frame (2) to be supported on the rectangular box (32A) of either supporting frame (3) and the vertical side walls (31A) of the two supporting frames (3) to block up two opposite open ends of the channel-like base frame (2).

2. The buffer device of claim 1 wherein the punched cardboard (20) for the channel-like base frame (2) comprises two opposite side wall reinforcing panels (23) and two Opposite side wall panels (22) respectively folded up and side matched to form the vertical side walls (22A) for the channel-like base frame (2), the side wall reinforcing panels (23) having each a rectangular flap (230) in the middle respectively inserted into a respective longitudinal slot (202) on the horizontal bottom wall (21A).

3. The buffer device of claim 1 wherein the horizontal bottom wall (21A) of the channel-like base frame (2) comprises a cut line (211) defining a baffle flap (212).

4. The buffer device of claim 1 wherein one vertical side wall (22A) of the channel-like base frame (2) comprises two rectangular supporting flaps (221) longitudinally spaced in the middle formed and defined by a respective cut line (220), the supporting flaps (221) having each a rectangular through hole (223) for supporting a lamp tube, and two stop flaps (226) defined by a respective cut line (224) for stopping either end of the lamp tube.

5. The buffer device of claim 1 wherein the cardboard (30) for either supporting frame (3) comprises a first panel (31) divided into a side wall panel (311) and a side wall reinforcing panel (312), the side wall panel (311) and the side wall reinforcing panel (312) being folded up and side matched to form the vertical side wall (31A), the vertical side wall (31A) comprising a horizontal retaining slot (314A); the rectangular box (32A) of either supporting frame (3) comprises a retainer flap (327) defined by a cut line (326) and engaged into the horizontal retaining slot (314A), causing the rectangular box (32A) and the respective vertical side wall (31A) side matched.

6. The buffer device of claim 5 wherein the cardboard (30) for either supporting frame (3) further comprises a second panel (32) linked to the respective first panel (31) by a transverse folding line (301) and divided into a plurality of panels (324;323;322;321;320) by parallel folding lines (306;305;304;303) and folded up to form the rectangular box (32A).

7. The buffer device of claim 6 wherein the rectangular box (32A) of either supporting frame (3) comprises two retaining slots (325) horizontally transversely disposed at the top; the horizontal bottom wall (21A) of the channel-like base frame (2) comprises two pairs of retainer flaps (216) bilaterally disposed at the bottom and respectively engaged into the retaining slots (325) on the rectangular box (32A) of either supporting frame (3).

* * * * *